US008757400B2

(12) United States Patent
Bosch

(10) Patent No.: US 8,757,400 B2
(45) Date of Patent: Jun. 24, 2014

(54) TEST TUBE RACK

(75) Inventor: Bernd Bosch, Emmendingen (DE)

(73) Assignee: Bernd Bosch Maschinenbau, Emmendingen (DE)

( * ) Notice: Subject to any disclaimer, the term of this patent is extended or adjusted under 35 U.S.C. 154(b) by 101 days.

(21) Appl. No.: 13/395,538

(22) PCT Filed: Aug. 25, 2010

(86) PCT No.: PCT/EP2010/005198

§ 371 (c)(1),
(2), (4) Date: Mar. 12, 2012

(87) PCT Pub. No.: WO2011/029529

PCT Pub. Date: Mar. 17, 2011

(65) Prior Publication Data

US 2012/0175328 A1 Jul. 12, 2012

(30) Foreign Application Priority Data

Sep. 11, 2009 (DE) ..... 10 2009 041 219

(51) Int. Cl.

| | |
|---|---|
| ***A47G 29/00*** | (2006.01) |
| ***A47F 7/00*** | (2006.01) |
| ***A47F 1/04*** | (2006.01) |
| ***A47F 3/14*** | (2006.01) |
| ***B01L 9/06*** | (2006.01) |
| ***A47F 7/28*** | (2006.01) |
| ***B01L 3/00*** | (2006.01) |
| ***A47B 73/00*** | (2006.01) |
| ***A47B 87/02*** | (2006.01) |

(52) U.S. Cl.

CPC . *B01L 9/06* (2013.01); *A47F 7/281* (2013.01); *A47F 7/283* (2013.01); *A47F 7/0028* (2013.01); *B01L 3/5082* (2013.01); *A47B 73/006* (2013.01); *A47B 87/0215* (2013.01); *A47B 87/0223* (2013.01)

USPC ..... 211/85.18; 211/59.4; 211/126.12; 211/74

(58) Field of Classification Search

CPC ..... A61B 19/0256; A61B 19/26; A61B 19/0259; A61B 7/0503; A61B 2019/0258; A61B 2019/0259; B01L 9/068; B01L 9/06; B01L 9/54; B01L 9/543; B01L 9/065; B01L 3/5082; B01L 3/50; A47B 73/00; A47B 7/28; A47B 7/281; A47B 7/283; A47B 81/007; A47B 81/00; A47B 73/006; A47B 87/0261; A47B 87/0269; A47B 87/0276; A47B 87/0223; A47B 87/02; A47B 87/0207; A47B 87/0215; A47B 87/0246; A47B 87/0253; A47G 23/02; A47F 7/28; A47F 7/281; A47F 7/283; A47F 5/10; A47F 7/0021; A47F 7/0028; F16C 13/084; B42F 7/12; B65D 71/70; B65D 85/20; B65D 85/24

USPC ..... 211/74, 85.13, 85.18, 188, 194, 126.14, 211/59.4, 10, 13.1, 60.1, 70.6, 126.2, 211/126.12; 422/101, 104, 913, 914, 915; 206/528, 438, 563, 558, 564, 363, 446

See application file for complete search history.

(56) References Cited

U.S. PATENT DOCUMENTS 2,726,771 A * 12/1955 Cozzoli ..... 211/74
3,682,323 A 8/1972 Bergquist et al.

(Continued)

*Primary Examiner* — Jennifer E Novosad
(74) *Attorney, Agent, or Firm* — Volpe and Koenig, P.C.

(57) ABSTRACT

A test tube rack (1) that is suited for storing and transporting test tubes. The test tube rack (1) according to the invention includes a bottom plate (3), a cover plate (2), and a centering plate (4), which are arranged parallel to one another and spaced apart from one another. The plates have a substantially rectangular shape. At each corner a screw connector (8) is arranged, through which the plates are joined to each other. The screw connectors (8) are designed such that, when stacking a plurality of test tube racks (1), the screw connectors (8) of one test tube rack (1) partially engage with the screw connectors (8) of another test tube rack (1), and thereby ensure a secure connection, at least with respect to lateral shifting. Additionally, the screw connectors (8) can be provided with a locking mechanism, which allows a rigid connection between test tube racks (1).

12 Claims, 4 Drawing Sheets

(56) References Cited

U.S. PATENT DOCUMENTS

| | | | | | |
|---|---|---|---|---|---|
| 3,778,232 | A | * | 12/1973 | McMorrow, Jr. | 422/65 |
| 3,871,832 | A | * | 3/1975 | Leblanc | 422/562 |
| 4,040,234 | A | | 8/1977 | Stockdale et al. | |
| 4,090,612 | A | * | 5/1978 | Lostutter | 211/13.1 |
| 5,123,552 | A | * | 6/1992 | Aggelen | 211/194 |
| 5,133,939 | A | * | 7/1992 | Mahe | 422/562 |
| 6,216,894 | B1 | * | 4/2001 | Hendricks | 211/194 |
| 6,568,544 | B1 | * | 5/2003 | Lafond et al. | 211/74 |
| 6,796,565 | B2 | * | 9/2004 | Choi et al. | 280/47.35 |
| 7,066,342 | B2 | * | 6/2006 | Baechle et al. | 211/191 |
| 7,115,231 | B1 | * | 10/2006 | Zhou et al. | 422/552 |
| 7,137,517 | B2 | * | 11/2006 | Lowry et al. | 211/188 |
| 7,258,240 | B2 | * | 8/2007 | Wescott, III | 211/74 |
| 8,459,476 | B2 | * | 6/2013 | Malekmadani | 211/188 |
| 2005/0165287 | A1 | | 7/2005 | Wescott, III | |

* cited by examiner

TEST TUBE RACK

BACKGROUND

The invention relates to a test tube rack with a plurality of wells for test tubes, with a bottom plate, a cover plate, and a centering plate arranged therebetween, wherein the three plates are arranged parallel to one another and spaced apart from one another, and the cover plate and centering plate in each case have, at each well, a congruent opening for receiving a test tube, and the bottom plate is formed continuously without openings at the wells.

A test tube rack of this kind is made, for example, of sheet steel, with two side parts integrally connected to the cover plate. The centering plate and the bottom plate are secured on these side parts by spot weld connections. Alternatively, the side parts can be integral with the bottom plate or can be separate parts.

However, the spot welding results in the side parts having cavities in which dirt or liquids can gather.

Other known test tube racks use rods or other connecting elements, to which the plates are secured, for example by welding or adhesive bonding.

In laboratories, these test tube racks serve both as a storage rack for storing and transporting empty or filled test tubes and also as a work rack for carrying out routine laboratory work. The problem arises that test tube racks having multiple rows are less suitable for working with, since the back rows are difficult to see. At the same time, however, the known test tube racks are also not particularly suitable as a storage rack, since they require a large area to stand on and are difficult to handle.

SUMMARY

The object of the invention is therefore to make available a test tube rack of the aforementioned type which is especially suitable for storing and transporting test tubes and which by comparison requires a smaller area to stand on.

According to the invention, this object is achieved in that the bottom plate, cover plate and centering plate are each connected to one another by at least three screw connectors, and that the screw connectors are designed in such a way that a plurality of test tube racks can be stacked together and, during stacking, the screw connectors of one test tube rack engage partially in the screw connectors of the other test tube rack.

The screw connectors are designed such that they each connect all three plates to one another, thus forming a stable and sturdy rack. The screw connectors are preferably designed such that no cavities or edges occur in which dirt can gather.

It is important, however, that a plurality of test tube racks according to the invention can be stacked on top of one another, with the screw connectors of one rack each engaging partially in the screw connectors of the other rack. The advantage of the test tube rack according to the invention is that even test tube racks equipped with test tubes can be stacked together. For this purpose, the screw connectors are dimensioned such that the spaces between two stacked test tube racks are large enough.

By virtue of the fact that the screw connectors engage partially in one another, at least a lateral shifting of the test tube racks is prevented and good stability is ensured.

By stacking a plurality of racks together, it is thus possible for a large number of test tubes in total to be stored on the standing area of one rack.

For transporting an individual rack, it is expedient if the test tube rack has lateral carrying handles, which are arranged opposite each other on the cover plate or centering plate.

The screw connectors can be configured in various ways. In a preferred embodiment, the screw connectors have a continuous connector rod and an upper connector head and lower connector head. The connector rod passes through all three plates and is fixed from above and below by the connector heads. For this purpose, the connector rod has an external thread, preferably at least at both ends, although a threaded rod with a continuous thread can also be used. The connector heads each have internal threads, with which the connector heads can be screwed onto the connector rod.

Spacers are preferably arranged between the plates and keep the plates spaced apart from each other. These spacers are expediently sleeve-shaped and are arranged coaxially on the connector rods. However, the spacers can also be arranged separately from the screw connector at another location.

To allow the test tube racks to be stacked together in a manner secure against shifting, a preferred embodiment of the invention is one in which the upper connector heads each have a projection, the lower connector heads each have a recess, and, when a plurality of test tube racks are stacked together, the projection engages in the recess. Such a projection can be cylindrical, polygonal or of any desired shape, and the recess is designed with a substantially complementary shape.

The connection of two test tube racks that have been stacked together can be secured by an additional locking mechanism. For this purpose, at least two of the screw connectors preferably additionally have a locking mechanism. The test tube racks connected to and locked onto each other in this way form a unit and can be handled jointly.

In one embodiment of the locking mechanism, provision is made that the projection has a groove or notch, that the lower connector head has a spring-actuated locking element, which is arranged in the recess, and that, when test tube racks are stacked together, the locking element engages in the groove or notch.

The shape of the test tube rack is not essential to the invention. Preferably, the individual plates are substantially rectangular and are connected to one another in each corner by a screw connector. However, the plates can also be square, round or triangular, for example, and, in the latter two cases, three screw connectors are sufficient to obtain good stability.

Particularly in the embodiment of the test tube rack with a locking mechanism, it is expedient if a lid with carrying handle can be placed on the test tube rack and can be secured by the locking mechanism. In this way, a test tube rack, or a unit composed of several test tube racks stacked and locked together, can be comfortably transported using the carrying handle of the lid.

The height of the test tube rack is preferably dimensioned such that the test tube racks can also be stacked together when fitted with test tubes. The centering plate is preferably arranged substantially in the middle between cover plate and bottom plate.

BRIEF DESCRIPTION OF THE DRAWINGS

The invention is explained in more detail below on the basis of illustrative embodiments and with reference to the attached drawings, in which.

DETAILED DESCRIPTION OF THE PREFERRED EMBODIMENTS

Figure 1:
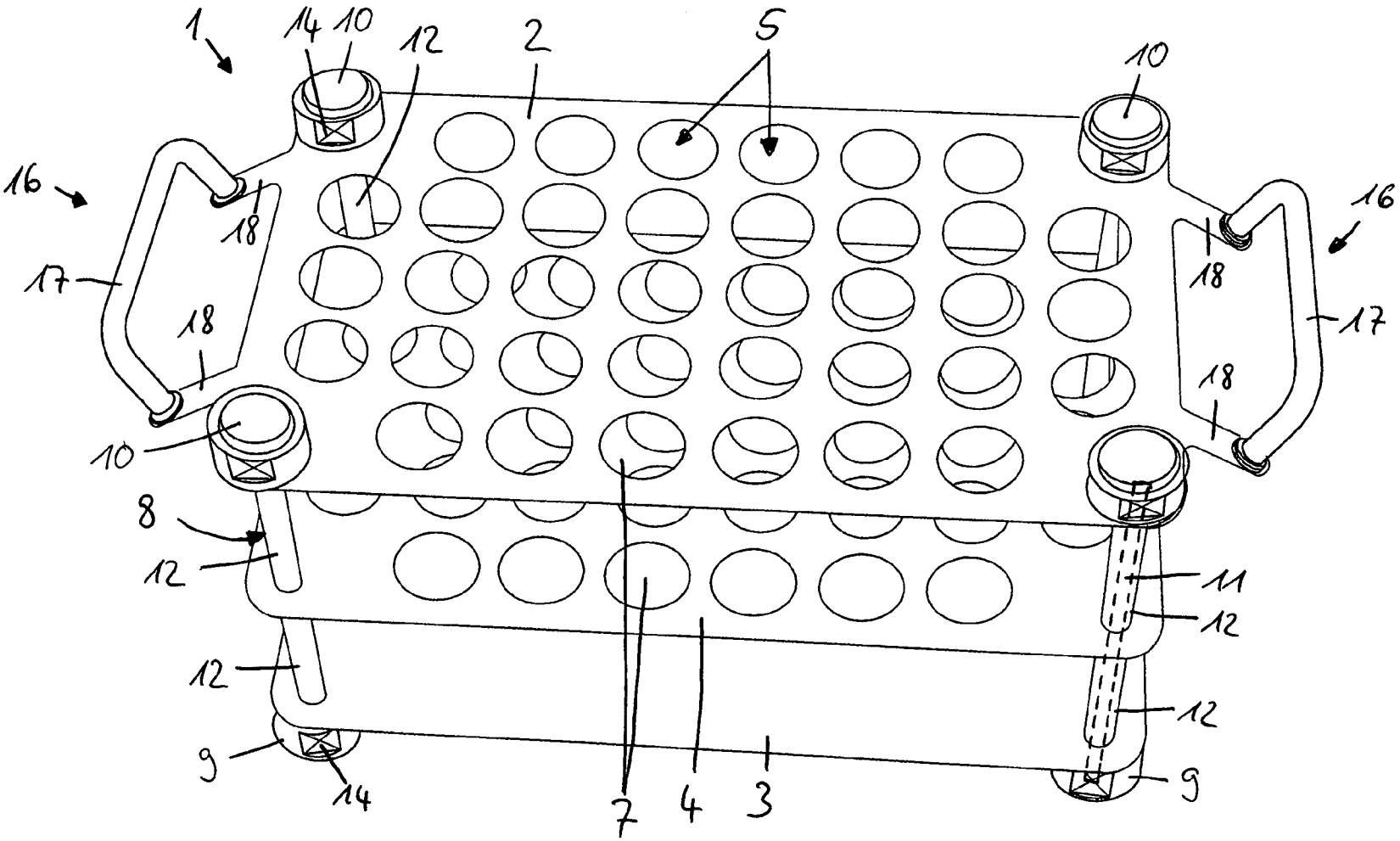
FIG. 1 shows an oblique view of a test tube rack according to the invention with rectangular plates and four screw connectors.

In FIG. 1, a test tube rack according to the invention is designated overall by reference number 1. The test tube rack 1 has a cover plate 2, a bottom plate 3 and, arranged substantially midway between these, a centering plate 4, said plates being parallel to one another. The plates 2, 3, 4 are substantially the same size and have a rectangular shape with rounded corners. The shape of the plates is not essential to the invention, and therefore square, triangular or round plates can also be used.

In the exemplary embodiment, the test tube rack has thirty-six wells 5 for test tubes 6 with a diameter of 20 mm or 25 mm. The wells 5 each have a congruent, circular opening 7 in the cover plate 2 and in the centering plate 4. The bottom plate 3 has no openings at the wells 5, such that any drips of liquid are caught in the test tube rack 1.

Like the shape of the openings 7, the number of wells 5 is also not essential to the invention, and therefore the test tube rack 1 can be scaled to any desired degree. For example, a test tube rack 1 with the same standing area can also have fifty-six wells 5 for 16-mm test tubes or forty-one wells 5 for 18-mm test tubes.

The individual plates 2, 3, 4 are connected to one another by four screw connectors 8, each one arranged in a corner. Each screw connector 8 has a lower connector head 9, an upper connector head 10, a connector rod 11 and two sleeve-shaped spacers 12. The substantially cylindrical connector heads 9, 10 each have an internal thread 13, into which the external thread of the connector rod 11 can be screwed. At their corners, the plates each have a bore for the passage of the connector rod 11.

The test tube rack 1 is now easily constructed as follows. The lower connector heads 9 serve as support feet for the test tube rack 1. The connector rods 11 are screwed into the lower connector heads 9. The bottom plate 3 is placed on the lower connector heads 9, a respective connector rod 11 passing through each of the bores in the corners of the bottom plate 3. Spacers 12 are now each pushed coaxially onto the connector rods 11 and bear on the bottom plate 3. The centering plate 4 lies on the spacers 12. Further spacers 12 define the distance between centering plate 4 and cover plate 2. The upper connector heads 10 are now screwed over the cover plate 2 onto the connector rods 11, as a result of which all the structural parts are pressed against each other and fixed. On the circumference, the connector heads 9, each have two mutually opposite flats 14, to which a fork wrench can be applied for tightening the screw connectors 8. However, the connector heads can also have other means to permit tightening.

Instead of a continuous connector rod 11 with spacers 12, a two-part connector rod can also be used which at the same time serves as a spacer and is screwed via an additional pair of threads, with the centering plate 4 being clamped in this screw connection.

Figure 2:
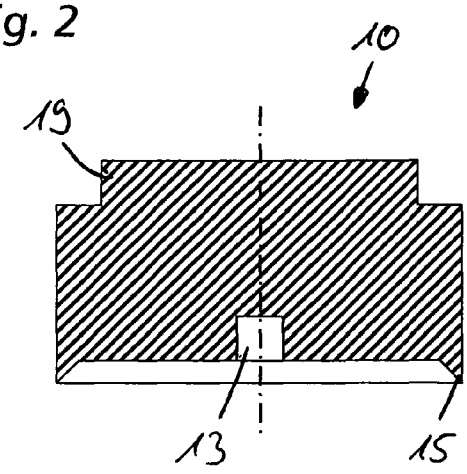
FIG. 2 shows a schematic cross-sectional view of an upper connector head.
Figure 3:
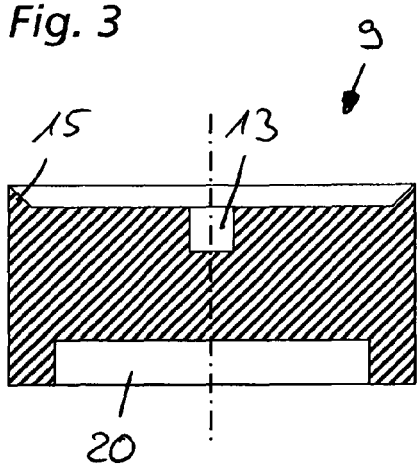
FIG. 3 shows a schematic cross-sectional view of a lower connector head.

As is shown in an exaggerated form in FIGS. 2 and 3, the connector heads 9, 10, on the side resting on a plate, have a tapering peripheral edge 15, which is flush with the outer circumference. When the screw connectors 8 are tightened, this edge 15 is pressed into the respective plate surface and forms an annular groove there. By virtue of the plastic deformation, the connection between connector head and plate is substantially sealed off, such that no liquid and no dirt can get into the gap between connector head and plate.

Analogously, the spacers 12 also have tapered edges of this kind on their end faces, such that the connections between the spacers and the plates are also sealed off in this way. However, this is not shown in the drawings.

A carrying handle 16, by which the test tube rack 1 can be easily transported, is arranged on each of the narrow sides of the cover plate 2. The carrying handle 16 is formed by a U-shaped bracket 17 which is secured, for example by screw connections, on two tabs 18 formed integrally with the cover plate 2. However, the carrying handle can also be designed in another way, for example entirely in one piece with the cover plate. Alternatively, the carrying handles can also be arranged on the centering plate 4. An individual rack 1 can be transported easily and comfortably using this carrying handle.

The upper connector heads 10 each have a central, cylindrical projection 19, as can be seen more clearly in FIG. 2. The lower connector heads 9 each have a recess 20 matching the projection 19 (FIG. 3).

With this design of the screw connectors, it is possible for a plurality of test tube racks 1 according to the invention to be stacked on top of one another.

If a plurality of such test tube racks 1 are now stacked on top of one another, the projections 19 of the upper connector heads 10 of one test tube rack 1 engage in each case in the recesses 20 of the lower connector heads 9 of the other test tube rack 1. This creates a connection between the test tube racks 1 that at least prevents a lateral shifting.

The distances between the individual plates 2, 3, 4 and the heights of the connector heads 9, 10 are preferably dimensioned such that there is enough free space for test tubes 6, such that test tube racks 1 fitted with test tubes can also be stacked.

The fact that the test tube racks 1 can be stacked means that, compared to the prior art, a large number of test tubes 6 can be stored or transported on the same standing area.

To make transport even safer, the screw connectors 8 can additionally have a locking mechanism, which permits a releasable, secure connection between two test tube racks 1. These screw connectors with locking mechanism have an upper connector head 21 as shown in FIG. 4 and a lower connector head 22 as shown in FIG. 5.

Compared to the connector head 10 in FIG. 2, the upper connector head 21 has a higher, narrower and substantially cylindrical projection 19 which, at its free end 23, tapers in the shape of a truncated cone. Approximately half way along its length, the projection 23 has a circumferential groove 24.

Figure 5:
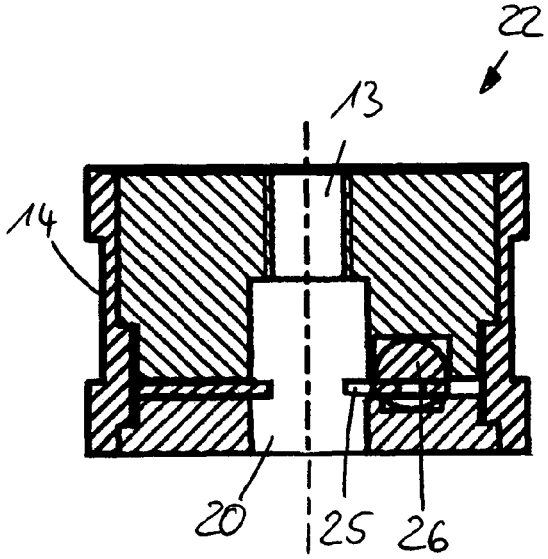
FIG. 5 shows a cross-sectional view of an alternative lower connector head with a locking mechanism.
Figure 6:
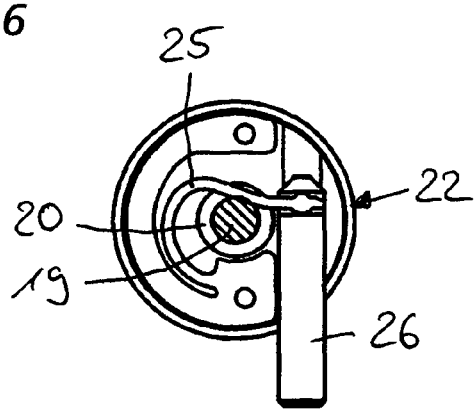
FIG. 6 shows a transverse section through the connector head of FIG. 5, with the upper connector head locked, and the locking mechanism visible.

The lower screw connector 22 (FIG. 5) has a recess 20 into which the projection 19 of the upper screw connector 21 can engage. In addition, the lower connector head 22 has a spring element 25 (FIG. 6), which is arranged in the lower third transversely with respect to the recess 20. In the example, the spring element 25 has approximately the shape of a question mark, although a straight or a differently shaped spring element 25 would also be suitable. The spring element 25 is connected to a push rod 26, which is guided movably and tangentially in the connector head 22 and via which the spring element 25 can be tensioned. In the untensioned state, the spring element 25 protrudes partially into the recess 20, while in the tensioned state the recess 20 is free. The spring element 25 can also be operated by another actuator element.

Figure 4:
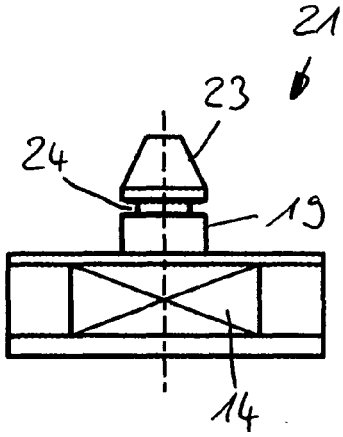
FIG. 4 shows a side view of an alternative embodiment of an upper connector head with an additional locking mechanism.

When the lower connector head 22 is placed onto an upper connector head 21 as per FIG. 4, the spring element 25 is initially tensioned by the frustoconical projection 23, such that the recess 20 is free and the projection 19 can be completely inserted. As soon as the circumferential groove 24 reaches the height of the spring element 25, the spring element 25 relaxes and engages at least partially in the groove 24. The projection 19 is thereby fixed in the recess 20.

To release this locked connection, the spring element 25 has to be tensioned by pressing the push rod 26, until the recess 20 is free, and has to be held until the projection 19 is removed from the recess 20.

Generally, other known forms of locking are also conceivable. The design shown here is given only by way of example and is not in any way limiting.

Figure 7:
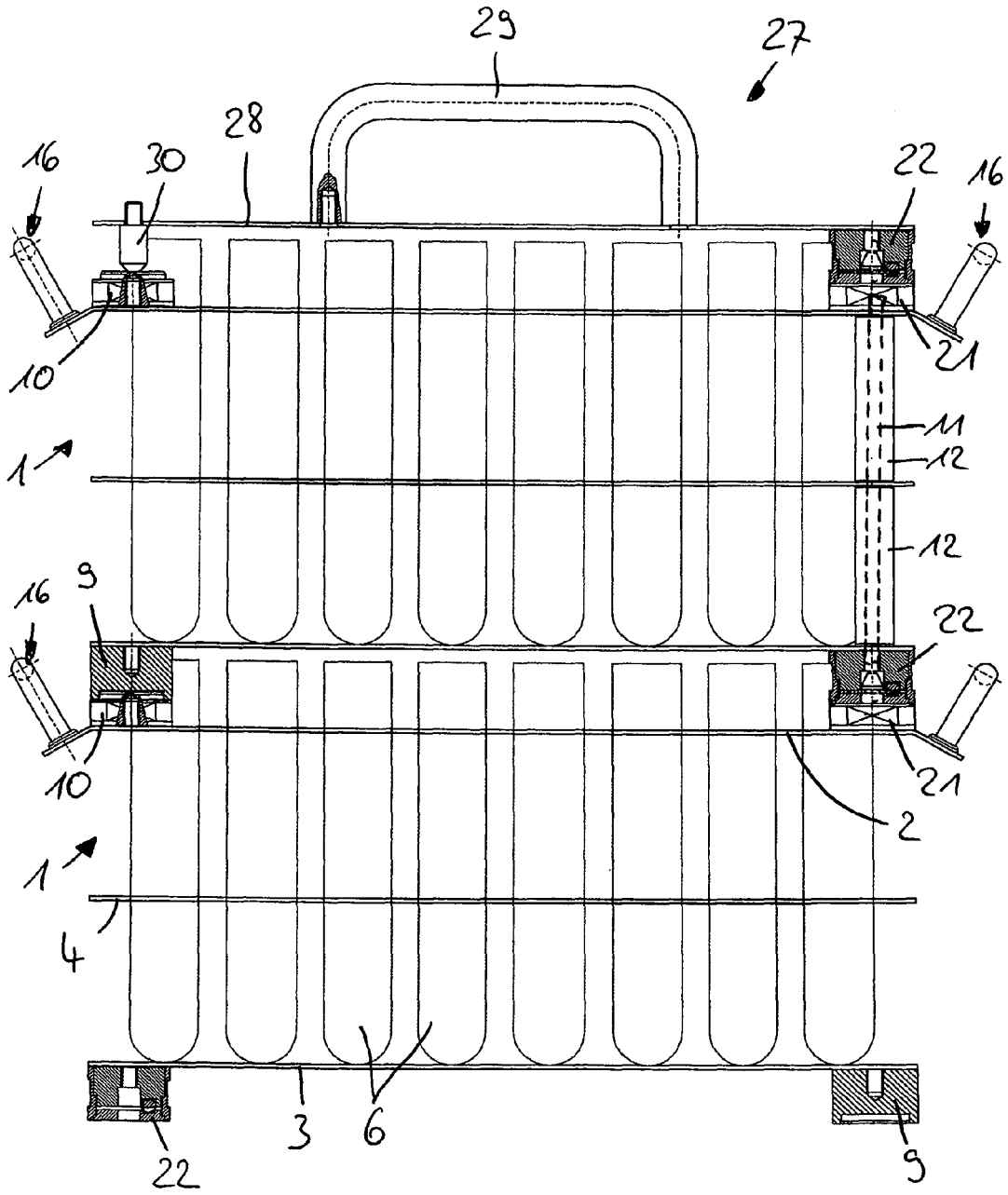
FIG. 7 shows a partial cross-sectional view of two stacked and locked test tube racks with a lid.
Figure 8:
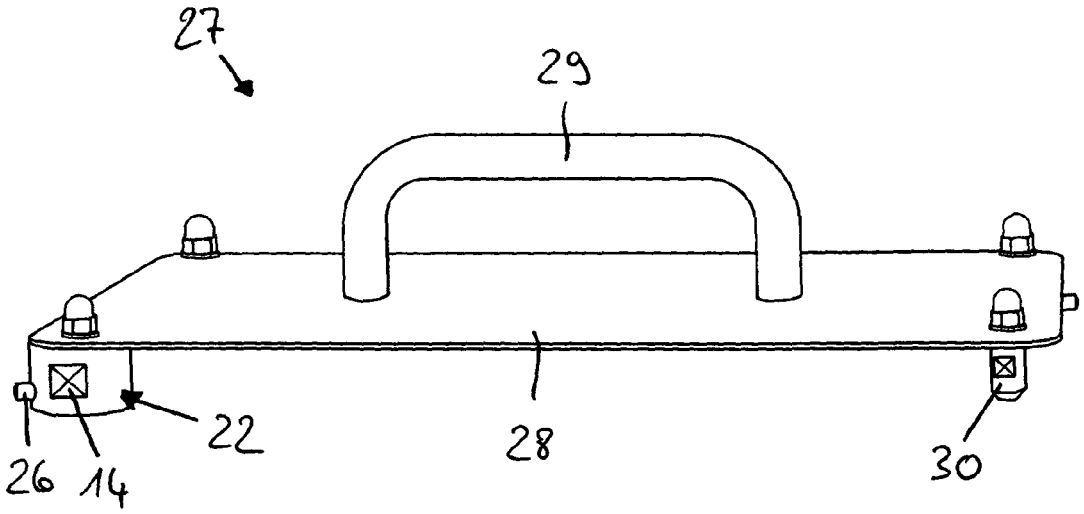
FIG. 8 shows a perspective view of the lid with carrying handle from FIG. 7.

FIG. 7 shows two test tube racks 1 according to the invention stacked one on top of the other. In the example, each test tube rack has, at two diagonally opposite corners, connector heads with a locking mechanism 21, 22, whereas the two other corners have connector heads without a locking mechanism 9, 10. It is of course also possible for all the screw connectors to have locking mechanisms, but this makes the release of the locking mechanism difficult, since all four push rods 26 have to be operated at more or less the same time. Similarly, in the example, spacers 12 are shown only on one screw connector 8, and the connector rod 11 concealed in the spacer 12 is indicated by broken lines. However, the other screw connectors 8 have the same features.

The test tube rack 1 additionally has a lid 27. At each of two diagonally opposite corners, the lid 27 has a lower connector head with locking mechanism 22. The lid 27 can thus be connected securely to a test tube rack 1 that has upper connector heads with locking mechanism 21. The two other corners merely have stubs 30, which have the same height as the connector heads 22 and thus bear on the connector heads 21 of a test tube rack 1.

The lid 27 has a continuous lid plate 28, which completely covers the test tube rack 1 and prevents test tubes 6 from falling out at the top and prevents dirt from getting into the test tubes 6. The lid 27 also has a U-shaped handle 29, by which one or more test tube racks 1 locked underneath it can be comfortably carried with one hand. The handle 29 is preferably screwed onto the lid plate 28.

By means of the locking mechanism and the lid 27, it is also possible for a plurality of fully stocked test tube racks to be stacked and safely transported.

The test tube rack 1 according to the invention can also be part of a system that includes test tube racks 1 for different test tube diameters. All the racks 1 of the system have the same standing area and can be stacked on top of one another in any desired manner.

In another expedient embodiment, the lower connector heads without locking mechanism as per 3 can have an additional recess into which the projection of the upper connector head as per FIG. 4 can be inserted. At the same time, the lower connector heads as per FIG. 5 must have an additional recess for the projection of the upper connector head as per FIG. 2. In this way, test tube racks with locking mechanism and test tube racks without locking mechanism can be stacked on top of one another in any desired combination, with no locking being carried out in some circumstances.

In addition, the test tube rack 1 can have an inscription plate or similar inscription possibility, such that the rack and/or also individual wells can be clearly identified. The inscription plate can be connected fixedly to the rack, for example screwed onto it.

Moreover, shelves or other transportation means present in trucks or in automobiles, for example, can have connector heads which have a locking mechanism and which are compatible with the test tube rack, such that the racks can be securely locked in the shelf. This permits safe transportation of the racks in the shelves without additional holding means.

The invention claimed is:

1. A test tube rack with a plurality of wells for test tubes, comprising a bottom plate, a cover plate, and a centering plate arranged therebetween, wherein the bottom, cover, and centering plates are arranged parallel to one another and spaced apart from one another, and the cover plate and the centering plate each have, at each of the wells, a congruent opening for receiving a test tube, and the bottom plate is formed continuously without openings at the wells, the bottom plate, the cover plate and the centering plate are each connected to one another by at least three screw connectors and include a continuous connector rod and an upper connector head and a lower connector head, and the screw connectors are constructed such that a plurality of test tube racks can be stacked together and, during stacking, the screw connectors of one of the test tube racks engage partially in the screw connectors of another one of the test tube racks.

2. The test tube rack as claimed in claim 1, wherein the test tube rack has lateral carrying handles, which are arranged opposite each other on the cover plate or the centering plate.

3. The test tube rack as claimed in claim 1, wherein the connector rod has external threads at least at both ends, and the connector heads each have internal threads, with which the connector heads being screwed onto the connector rod.

4. The test tube rack as claimed in claim 3, wherein spacers are arranged between the plates.

5. The test tube rack as claimed in claim 4, wherein the spacers are sleeve-shaped and are arranged coaxially on the connector rods.

6. The test tube rack as claimed in claim 3, wherein the upper connector heads each have a projection, the lower connector heads each have a recess, and when a plurality of test tube racks are stacked together, the projection of one of the test tube racks engages in the recess of another of the other test tube rack.

7. The test tube rack as claimed in claim 6, wherein at least two of the screw connectors have a locking mechanism.

8. The test tube rack as claimed in claim 7, wherein the projection has a groove or notch, the lower connector head has a spring-actuated locking element, which is arranged in the recess, and upon stacking test tube racks together, the locking element engages in the groove or notch.

9. The test tube rack as claimed in claim 7, wherein a lid with a carrying handle is provided on the test tube rack and can be secured by a locking mechanism.

10. The test tube rack as claimed in claim 1, wherein the bottom, cover, and centering plates are substantially rectangular, and one of the screw connectors is arranged in each corner.

11. The test tube rack as claimed in claim 1, wherein the centering plate is arranged substantially in a middle between cover plate and bottom plate.

12. A test tube rack system comprising a plurality of test tube racks as claimed in claim 1, wherein the test tube racks are configured to receive different test tube diameters, have the same standing area, and can be stacked together in any desired manner.

* * * * *